US005709584A

United States Patent [19]

Watkins

[11] Patent Number: 5,709,584

[45] **Date of Patent: *Jan. 20, 1998**

[54] PARTIALLY WRAPPED CONFETTI

[76] Inventor: James O. Watkins, 14920 Mt. Nebo Rd., Poolesville, Md. 20837

[ * ] Notice: The term of this patent shall not extend beyond the expiration date of Pat. No. 5,352,148.

[21] Appl. No.: 668,302

[22] Filed: Jun. 25, 1996

Related U.S. Application Data

[63] Continuation-in-part of Ser. No. 273,115, Jul. 11, 1994, Pat. No. 5,531,628, and a continuation-in-part of Ser. No. 557, 293, Nov. 14, 1995, Pat. No. 5,624,295.

[51] Int. Cl.[6] ..... A63H 37/00

[52] U.S. Cl. ..... 446/475; 446/491; 124/5

[58] Field of Search ..... 446/34, 475, 491, 446/429; 40/216; 124/5

[56] References Cited

U.S. PATENT DOCUMENTS

| | | |
|---|---|---|
| 245,422 | 8/1881 | Weed . |
| 262,240 | 8/1882 | Newby . |
| 585,805 | 7/1897 | Wilhelmi . |
| 2,871,597 | 2/1959 | Yost . |

FOREIGN PATENT DOCUMENTS

| | | | |
|---|---|---|---|
| 360280 | 4/1906 | France | 446/475 |
| 361617 | 9/1906 | France | 446/475 |
| 866329 | 4/1941 | France | 40/216 |
| 112599 | 8/1900 | Germany | 446/475 |
| 174928 | 9/1906 | Germany | 446/487 |
| 341784 | 1/1931 | United Kingdom | 446/475 |
| 2250256 | 6/1992 | United Kingdom . | |

OTHER PUBLICATIONS

"Four Seasons Address Labels", Foster House Catalog, Christmas Dec. 1976, p. 33.

*Primary Examiner*—Michael A. Brown
*Assistant Examiner*—Jeffrey D. Carlson
*Attorney, Agent, or Firm*—Ronald B. Sherer

[57] ABSTRACT

A stack of confetti is disclosed which is wrapped by a wrapper about only a portion of the circumference of the stack whereby insertion of the stack into a launcher is facilitated and the aerodynamics of the stack in the air are substantially improved.

20 Claims, 2 Drawing Sheets

PARTIALLY WRAPPED CONFETTI

RELATED APPLICATIONS

This Application is a Continuation-In-Part of application Ser. No. 08/273,115, filed 11 Jul. 1994 now U.S. Pat. No. 5,531,628 and application Ser. No. 08/557,293 filed 14 Nov. 1995 now U.S. Pat. No. 5,624,295, said Patent and Application being hereby incorporated by reference.

FIELD OF THE INVENTION

This invention relates to confetti, and more particularly, to a large plurality of pieces of confetti which are stacked in face-to-face relationship to form a stack of confetti and the stack is partially wrapped by a wrapper extending about less than the full circumference of the stack.

BACKGROUND

While confetti has long been used at various types of celebrations, its use has been restricted by the difficulty in launching bulk confetti into the air so as to attain a desired height, and effective dispersion or pattern of the individual pieces, without the use of an explosive or a source of compressed gas. That is, loose or bulk confetti has very little effective mass such that it is very difficult to project a handful of loose pieces of confetti very far into the air or to achieve a predictable display. For example, attempts have been made to blow confetti out of horns such as disclosed in U.S. Pat. Nos. 1,491,809 and 1,153,207. However, the small, loose pieces of bulk confetti have little or no effective mass such that they do not project very far into the air, and a strong set of lungs are required to achieve any significant dispersion of the individual pieces. Thus, blowing confetti out of a horn or other container is not suitable for either young children or elderly persons, and with any user, the visual effect is extremely limited.

In U.S. Pat. No. 5,352,148, which is hereby incorporated by reference, there is disclosed a unique form of confetti having an elongated tetragonal shape, and in co-pending application Ser. No. 08,080,534, now U.S. Pat. No. 5,403,225, which is hereby incorporated by reference, there is disclosed a method of launching stacks of confetti from an elongated hollow tube. The tube is held at one end and is waved forwardly with the forearm and with a flick of the wrist so as to create sufficient centrifugal force to eject the stacks of confetti from the tube; the stacks being wrapped or unwrapped as disclosed in these patents.

Parent application Ser. No. 08/273,115, now U.S. Pat. No. 5,531,628, discloses that stacks of confetti, wrapped or unwrapped, may be launched from a cup, and further teaches that the stack of confetti may be partially wrapped by a wrapper extending only partly around the circumference of the stack. The present invention relates to such partially wrapped stacks of confetti and the unique advantages thereof as will become more fully apparent from the following description of one preferred embodiment of the invention as illustrated in the following figures of drawing.

DETAILED DESCRIPTION

Figure 1:
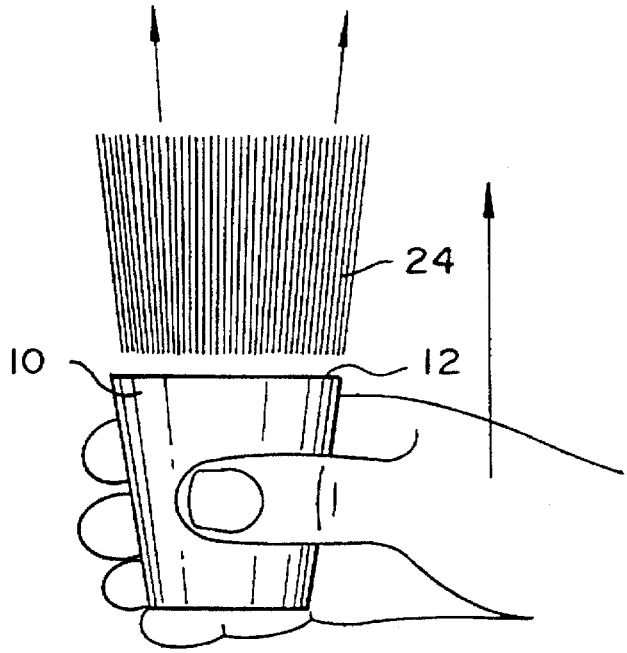
FIG. 1 is a side elevational view showing a stack of unwrapped confetti being launched from a cup.

FIG. 1 illustrates a cup 10 which may be composed of paper or plastic; translucent or clear plastic being preferred so that the multi-colored confetti 24 can be seen through the cup. While a wide variety of cup sizes are possible, one preferred size is that the cup be in the order of 1.5 to 4 inches tall with an upper opening 12 having a diameter in the order of 1.25 to 3 inches.

It is also preferred that the annular wall of the cup diverge outwardly in the upward direction, as illustrated in FIG. 1, such that the diameter of opening 12 is larger than that of the bottom portion. That is, while cups having purely cylindrical walls extending upwardly at right angles to the bottoms of the cups are possible to be used with the present invention, it has been discovered that maximum visual effects are obtained with cups having upwardly diverging walls for reasons which will be more fully explained hereinafter. Also, the top of cup 10 may be provided with a cap or lid (not shown) which is preferably of the snap-on type such that the lid stays closed over the top of the cup until it is manually removed prior to launching the confetti.

Figure 2:
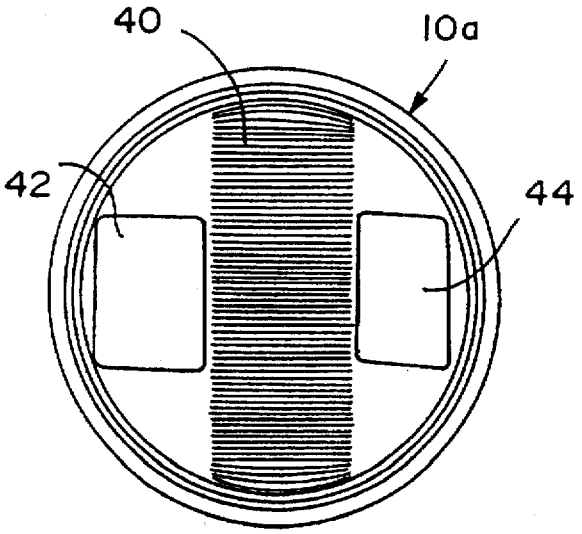
FIG. 2 is a top view of a cup containing wrapped and unwrapped stacks of confetti.

As shown in FIGS. 1 and 2, cup 10 is substantially filled with confetti 24. Confetti 24 is composed of individual pieces of lightweight material such as paper, tissue paper or plastic film, such as PVC or Mylar brand film. Most preferably, confetti 24 is composed of fireproof, biodegradable tissue paper having a thickness measured as eight to twenty pound test. The individual pieces of confetti are of four-sided or tetragonal shape such as more fully described in above mentioned U.S. Pat. No. 5,352,148 incorporated herein by reference. In brief, the shape of the confetti may be rectangular, or the shape may be that of a trapezoid, parallelogram or truncated triangle. In any of these shapes, the pieces are elongated in that their lengths are substantially greater than their widths, and preferably, their length to width ratio (L/W) is in the order of 1.5 to 4. The lengths of the pieces of confetti are cut slightly shorter than the vertical height of the cup, such as in the order of 1 to 4 inches, and preferably 2 to 2.75 inches. The widths of the individual pieces of confetti are preferably cut so as to maintain the L/W ratio of 1.5 to 4 and preferably the widths are in the order of one-quarter to one inch. As a result, the individual pieces of confetti fall through the air with their longitudinal axes extending horizontally, and they rotate about their horizontally extending, longitudinal axes such that they appear to flutter as they float slowly downwardly with a long hand time in the air.

As illustrated in FIGS. 1 and 2, cup 10 is preferably filled with one or more separate stacks of confetti arranged with their longitudinal axes extending substantially vertically. For example, one unwrapped stack such as stack 40 may extend diametrically across the cup, and wrapped stacks such as 42, 44 may be positioned as shown in FIG. 2 at the sides of central stack 40.

Referring to FIG. 1, the use of the cup to launch the confetti is as follows. After removing the lid, the user holds cup 10 between the thumb and two or three fingers with open top 12 directed upwardly. The hand and cup are then moved rapidly upwardly through a short vertical distance, such as about one foot, and the upward movement is then stopped suddenly. Because of the effective mass of the stacks of confetti, only a very short upward movement is necessary to create a momentum of the stacks such that, when the upward movement of the cup stops, the stacks of confetti continue upwardly and are ejected from the cup with a sufficient velocity and momentum to rise 6 or more feet into the air. This distance is more than sufficient for the confetti to reach the ceiling in a residence with a standard eight-foot ceiling whether the user is standing or seated. Also, this short, simple upward movement of the hand can be accomplished by either shoulder and/or elbow movement such that very effective, colorful and widely dispersed patterns of color and motion can be easily achieved by young children, the elderly and the infirm. Thus, the previously unattainable objects of achieving both maximum height and maximum dispersion, particularly in rooms with relatively low ceilings, and with a simple, nonstrenuous movement of the hand, are all achieved by the party favor of the present invention, and even with a small, two inch tall cup with a two inch top opening, over a thousand pieces of confetti may be launched in a colorful display.

As previously indicated, the embodiment discussed hereinabove in which the confetti is an unwrapped stack of loose pieces is particularly preferred for use in homes and other indoor party rooms with relatively low ceilings; however, use of the present invention is in no way limited to such locations. For example, use of the invention outdoors, or in buildings with high ceilings, is equally applicable and, for such locations where it is desired to attain greater heights than those previously described, several other forms of stacks will be described as follows.

Figure 3:
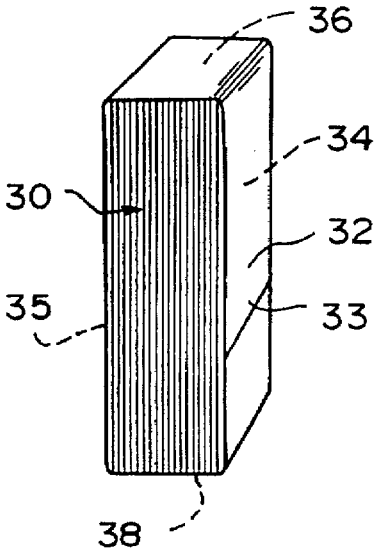
FIG. 3 is a perspective view of a wrapped stack of confetti.

Referring to FIG. 3, a stack 30 of elongated tetragonal confetti is shown as being wrapped one or more times by an outer wrapper 32 which terminates with an outer end 33. Outer wrapper 32 may be a strip composed of the same material as the confetti pieces comprising stack 30, however wrapper 32 is shown in darker line in order to distinguish the wrapper from the confetti pieces. As disclosed in U.S. Pat. No. 5,419,731 which is hereby incorporated by reference, wrapper 32 may be wrapped about the outer faces 34, 35 of the stack, extending parallel to the longitudinal axes of the pieces, and around both ends 36, 38 of the stack. The details of the unique wrapping method are further disclosed in said Patent. Thus, it is to be understood that stacks wrapped by a wrapper entirely around the faces and ends may be used in place of or with stacks which are unwrapped such as stacks 24 and 40 previously described. That is, for example, stack 24 of the FIG. 1 embodiment may be unwrapped, or it may be replaced by a wrapped stack 30. Wrapping of the stacks holds the stacks together for a longer time period as the stacks rise in the air such that greater heights can be obtained. Therefore, when the stacks are intended to be launched outdoors, or in rooms with high ceilings such as in auditoriums and theaters, some or all of the stacks in the cup are preferably wrapped.

Figure 4:
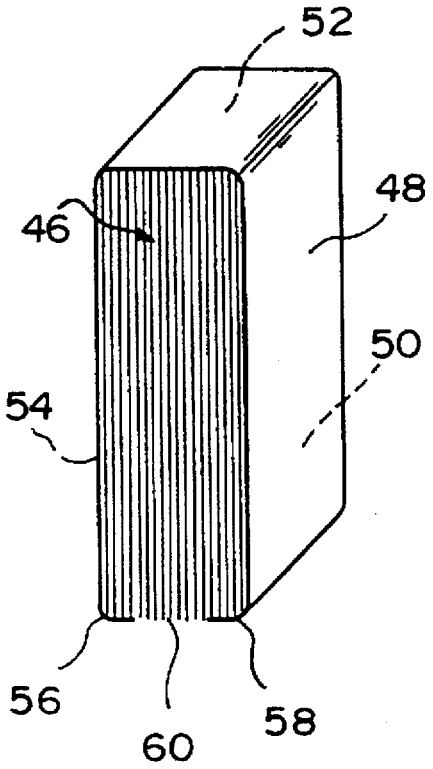
FIG. 4 is a perspective view of a partially wrapped stack of confetti.

In addition to the use of wrapped and/or unwrapped stacks of confetti as just described, it has also been discovered that partially wrapped stacks may be used to give optimum effects particularly in rooms with relatively low or intermediate height ceilings. As shown in FIG. 4, a stack 46 of elongated tetragonal confetti is shown with an outer wrapping 48. Wrapping 48 extends around front face 50 of the stack, around upper end 52 of the stack, and around rear face 54 of the stack. However, the lower ends of wrapper 48 terminate at or near the bottom corners, 56, 58 of the stack and do not extend fully around the bottom end 60 of the stack. Thus, stack 46 is effectively wrapped on three sides such that, when the stack is projected into the air with upper end 52 leading in an essentially vertical trajectory, the partial wrapping tends to hold the pieces of the stack together as the air flows around the wrapper covering the leading end 52 and along the sides of the wrapper which extend along the front and rear faces 50, 54 of the stack. However, as the velocity of the stack slows down, and/or if the stack hits a ceiling while the stack is still essentially wrapped, partial wrapper 48 opens fully and releases the pieces of confetti; i.e., without having to unwind or unravel as in the case of the fully wrapped stacks previously described. Therefore, while the partially wrapped stack may not reach the maximum height achieved by a fully wrapped stack, the partially wrapped stack is extremely effective in the case of low and intermediate height ceilings in achieving a sudden and wide burst pattern of the confetti pieces.

Partially wrapped stack 46 may be manufactured in several ways. However, the preferred method of manufacture is to first fully wrap the stack with the wrapper extending one or more times about the entire stack as shown and described with reference to FIG. 3. Preferably, this is accomplished according to the method of manufacture described in U.S. Pat. No. 5,419,731 hereby incorporated by reference. Thereafter, the portion of the wrapper extending about end 60 may be ruptured, torn or cut, either manually or by a cutter, so as to expose end 60 while maintaining the wrapper about the other three sides of the stack. The partially wrapped stack is then held by the front and rear faces of the wrapper so that the wrapper remains in place around the stack as the partially wrapped stack is inserted into a cup or launching tube or wand or other launching device.

Figure 5:
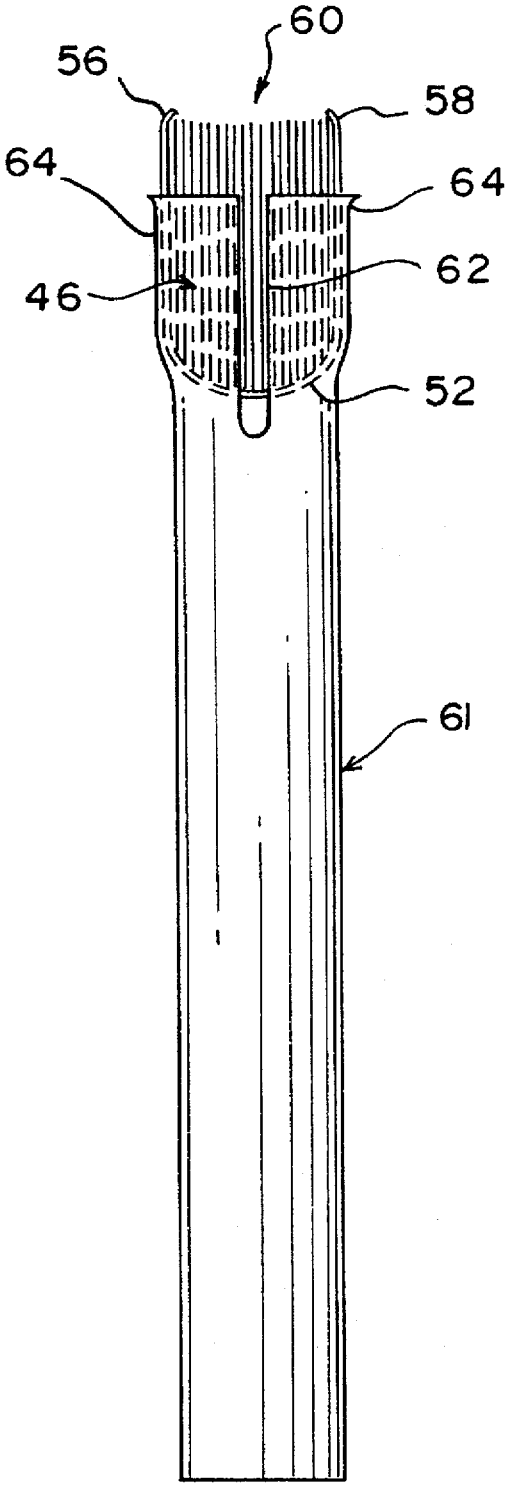
FIG. 5 is a side elevational view of a launching tube containing a partially wrapped stack of confetti.

It will also be apparent that, instead of inserting partially wrapped stack 46 into the cup or other launcher with the unwrapped end inserted first, partially wrapped stack 46 may be inserted as shown in FIG. 5 with wrapped end 52 inserted first and unwrapped end 60 facing away from the launcher. This positioning of the partially wrapped stack is further described in my co-pending application Ser. No. 08/557,293, now U.S. Pat. No. 5,624,295, which is hereby incorporated by reference. With the wrapped end of the stack being inserted first, the wrapper around that end substantially facilitates the insertion of the stack into the launcher. For example, where the launcher is a tube, or a tube with a slit 62 forming flexible fingers 64 as shown in FIG. 5, and as further described in application Ser. No. 08/557,293, the insertion of the stack with the wrapped end first significantly facilitates the insertion of the stack into the launcher. With the unwrapped end of the stack facing away from the launcher, it would be expected that the partial wrapper would have little effect, and that the stack of confetti would quickly burst apart immediately upon being projected out of the launcher. However, it has been discovered that the partial wrapper has a significant effect in retaining the stack of confetti together during the first portion of the flight, and thereby attains greater heights than in the case of the unwrapped stack. Thus, the partially wrapped stack provides both ease of insertion and improved aerodynamics. In addition, the partially wrapped stacks may be initially manufactured as fully wrapped stacks and shipped to the site of use fully wrapped. The ends of the wrapped stacks may then be removed prior to use depending upon the type of launcher and the height to which it is desired to project the stack of confetti before it bursts into a dramatic aerial display of color and motion.

From the foregoing description it will be apparent that numerous changes and variations are possible in the present invention, and it is to be understood that the foregoing description is intended to be illustrative of the principles of the invention, not limiting thereof, and that the invention is not intended to be limited other than as set forth in the following claims interpreted under the doctrine of equivalents.

What is claimed is:

1. A partially wrapped stack of confetti comprising:

(a) a large plurality of pieces of confetti, each of said pieces of confetti having a length;

(b) said large plurality of pieces of confetti being arranged in a stack with said lengths parallel to each other;

(c) a wrapper extending partially about said stack; and (d) some of said pieces of confetti being composed of tissue paper and some of said pieces of confetti being composed of plastic film.

2. Confetti means for projection into the air comprising:

(a) a stack of individual, unconnected pieces of confetti, said stack having a circumference;

(b) a wrapper extending partially around said circumference of said stack of pieces of confetti; and (c) an elongated hollow tube, said tube having an open end of a size and shape such as to receive said partially wrapped stack of confetti.

3. The confetti means and tube of claim 2 wherein the wrapped portion of said stack is inserted into said open tube end.

4. A partially wrapped stack of confetti comprising:

(a) a large plurality of pieces of confetti, said pieces of confetti being composed of material selected from the group consisting of tissue paper and plastic film;

(b) each of said pieces of confetti having a length and a width;

(c) said width being in the order of one-quarter to one inch;

(d) said large plurality of pieces of confetti being arranged in a stack with said lengths aligned parallel to each other;

(e) a wrapper; and (f) said wrapper extending only partially about said stack of pieces of aligned confetti.

5. The partially wrapped stack of confetti of claim 4 wherein said stack includes two face portions and two end portions, and said wrapper extends about said two face portions and about only one of said end portions.

6. The partially wrapped stack of confetti of claim 4 wherein said wrapper is composed of tissue paper.

7. The partially wrapped stack of confetti of claim 4 wherein said pieces of confetti are composed of tissue paper, and said tissue paper is of eight to twenty pound test.

8. The partially wrapped stack of confetti of claim 4 wherein said length is in the order of 1 to 4 inches.

9. A partially wrapped stack of confetti comprising:

(a) a large plurality of pieces of confetti, each of said pieces of confetti having a length, a width and an elongated tetragonal shape, said length being substantially greater than said width;

(b) each of said pieces of confetti being composed of tissue paper;

(c) each of said pieces of confetti having two faces, two side edges and two end edges, said side edges being separated by said width and said end edges being separated by said length;

(d) said plurality of pieces of confetti being stacked in face-to-face relationship with said lengths aligned in parallel to form a stack;

(e) said stack having two face surfaces, two end surfaces and two side surfaces; and (f) a wrapper extending partially about said stack, said wrapper extending about each of said face surfaces and only about one of said end surfaces.

10. The partially wrapped stack of confetti of claim 9 wherein said length is in the order of 1 to 4 inches.

11. The partially wrapped stack of confetti of claim 9 wherein said width is in the order of ¼ to 1 inch.

12. The partially wrapped stack of confetti of claim 11 wherein said length is in the order of 1 to 4 inches.

13. The partially wrapped stack of confetti of claim 9 wherein said wrapper is composed of tissue paper.

14. The partially wrapped stack of confetti of claim 10 wherein said wrapper is composed of tissue paper.

15. The partially wrapped stack of confetti of claim 11 wherein said wrapper is composed of tissue paper.

16. The confetti means of claim 2 wherein at least some of said pieces of confetti are composed of tissue paper.

17. The confetti means of claim 2 wherein said wrapper is composed of tissue paper.

18. The confetti means of claim 2 wherein said stack of pieces of confetti includes two end portions, and said wrapper extends around only one of said end portions.

19. The confetti means of claim 2 comprising in combination, a plurality of said stacks of confetti, each of said stacks of confetti having an individual wrapper extending only partially around said respective stack of confetti, and said plurality of stacks of partially wrapped confetti being contained within said tube.

20. The confetti means of claim 19 wherein each of said stacks of confetti have lengths and widths, and wherein said lengths are greater than said widths, and wherein said stacks have end portions separated by said lengths, and wherein each of said wrappers extend only about one end portion of each respective stack.

* * * * *